US005261654A

United States Patent [19]

Kerber et al.

[11] Patent Number: 5,261,654

[45] Date of Patent: Nov. 16, 1993

[54] SHEET CONVEYING SUCTION APPARATUS

[75] Inventors: Helmut Kerber, Rodermark; Peter Mayer; Gunther Schniggenfittig, both of Muhlheim/Main, all of Fed. Rep. of Germany

[73] Assignee: MAN Roland Bruckmaschinen AG, Fed. Rep. of Germany

[21] Appl. No.: 926,509

[22] Filed: Aug. 6, 1992

[30] Foreign Application Priority Data

Aug. 10, 1991 [DE] Fed. Rep. of Germany ..... 4126546

[51] Int. Cl.[5] ..... B65H 29/68

[52] U.S. Cl. ..... 271/183; 271/197; 198/689.1

[58] Field of Search ..... 271/183, 182, 197, 202; 414/794.4; 198/689.1

[56] References Cited

U.S. PATENT DOCUMENTS

| | | | |
|---|---|---|---|
| 3,389,908 | 6/1968 | Martin | 271/197 |
| 4,830,355 | 5/1989 | Jeschke et al. | 271/183 |
| 4,966,521 | 10/1990 | Frye et al. | 271/183 X |
| 5,133,542 | 7/1992 | von Kwiatkowski et al. | 271/183 |

FOREIGN PATENT DOCUMENTS

3638322A1 11/1987 Fed. Rep. of Germany .

*Primary Examiner*—David H. Bollinger
*Attorney, Agent, or Firm*—Leydig, Voit & Mayer

[57] ABSTRACT

A sheet conveyor table for delivering sheets from a printing press has upper and lower portions. The lower portion is secured adjacent a delivery unit of the printing press and the upper portion is releasably attached to the lower portion through a swivel joint and catch coupling. An endless conveyor belt is trained about a pair of guide rollers and a tensioning roller on the upper portion for continuous movement imparted by the rotational force of a drive wheel mounted on the lower portion of the table. A guide plate extends substantially parallel and closely adjacent the conveyor path for guiding sheet materials during transfer. A wedge-shaped suction aperture in the guide plate is adapted for communication with a vacuum source, thereby creating a downwardly directed suction force for braking and guiding the sheet materials during transfer. The suction aperture diverges with respect to the direction of travel of the conveyor belt, so as to create a continually increased vacuum force on the sheets during transfer and thereby progressively brake the sheet movement.

5 Claims, 1 Drawing Sheet

SHEET CONVEYING SUCTION APPARATUS

FIELD OF THE INVENTION

The present invention relates generally to a sheet conveyor apparatus, and more particularly to a suction hold-down conveyor table for a printing machine for braking and positioning sheet material to provide controlled transfer of the sheets.

BACKGROUND OF THE INVENTION

Conveyor apparatus of the kind having an endless belt travelling about drive and guide rollers to effectuate the transport of sheet material have long been known. Rapid conveyor speeds, however, create transfer problems for lightweight sheet materials, such as sheets of paper or cardboard.

A related problem exists in the sheet delivery units of printing machines. In these units, sheets are typically received from the printing press for final disposition at a stacking unit. In order to provide uniform stacking of the sheet material, the delivery units must provide a controlled braking action to effectuate the transition from the high-speed transfer of the printing press to the final, stacked position. Accordingly, various suction means for use with conveyor apparatus have been proposed to solve such transfer and delivery problems.

For example, U.S. Pat. No. 3,389,908 discloses the use of a toothed belt guided in a longitudinally grooved recess in a base plate. In order to reduce the friction on the underside of the toothed belt, the recess is subjected to ambient pressure on the side opposite the teeth. Separately, a vacuum is created on the exposed surface of the belt in the spaces between adjacent teeth, said vacuum being applied by way of longitudinally extending ducts disposed laterally along the sides of the toothed belt.

A disadvantage of this solution is that the sheets are no longer positionally fixed on the toothed belt by the vacuum in the region of the guide roller facing the sheet stack and each sheet has to cover a considerable remaining distance without any appreciable guidance or control. Frequently, this results in uneven delivery of the sheets and stack formation problems.

Another example is shown in DE 3,638,322, disclosing a sheet conveying device having a toothed belt guided in a base member. Suction ducts are formed laterally inside the base member in such a manner as to be open in the region of the tooth gaps and closed in the region of the teeth. A serious shortcoming of this solution, somewhat similar to the problem in the abovementioned U.S. Pat. No. 3,389,908, is that only the tooth gaps are active due to the change between the open and closed suction ducts and the braking effect is distributed superficially only over these gaps. As a result of the tooth pitch, the flow suction air is periodic which results in considerable fluctuations in the vacuum. Accordingly, there are constant variations in sheet braking and control.

OBJECTS AND SUMMARY OF THE INVENTION

In view of the foregoing, it is a primary object of the present invention to provide more effective and progressively controlled braking of sheet material in the delivery unit of a printing machine.

A related object of the present invention is to provide an apparatus for accurately positioning sheet materials in the delivery unit of a printing machine.

Still another object of the present invention is to provide an apparatus utilizing a vacuum hold-down to provide deliberate control of sheet material in the delivery unit of a printing machine.

Yet a further object of the present invention is to provide a sheet material transfer apparatus that is readily interchangeable for adaptation to the delivery of different size and weight sheets.

In its broadest aspects, the present invention is directed to a vacuum hold-down for braking and positioning sheet materials from the delivery unit of a printing press. More particularly, a sheet conveyor table is provided to transition sheet materials between the high-speed transfer of a printing press and the final, stacked position of the sheets.

The conveyor table includes upper and lower portions releasably coupled by a catch and swivel joint. In this way, the upper portion of the table is readily interchangeable for adaptation to a variety of sheet sizes and weights. Guide and tension rollers are disposed on the upper portion of the table to define the path for travel of an endless conveyor belt. A drive wheel is provided on the lower portion of the table for engaging the belt and propelling it around its endless path.

The upper surface of the conveyor table includes a guide plate that directs the sheet material along the conveyor table. The guide plate also defines a suction aperture that is in fluid communication with a vacuum source, so as to generate a suction air flow inwardly through the aperture. As sheet material passes over the upper portion of the conveyor table, the suction force directed through the aperture pulls the sheets downwardly into a snug engagement with the conveyor belt, thereby slowing the sheet speed to that of the conveyor belt. The suction aperture is diverging in shape in the direction of sheet travel and thus ensures that the vacuum force will be gradually applied to the sheets. Correspondingly, the braking action applied to the sheets will be gradually increased along their path of travel over the conveyor table.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention

DETAILED DESCRIPTION OF THE PREFERRED EMBODIMENT

Figure 1:
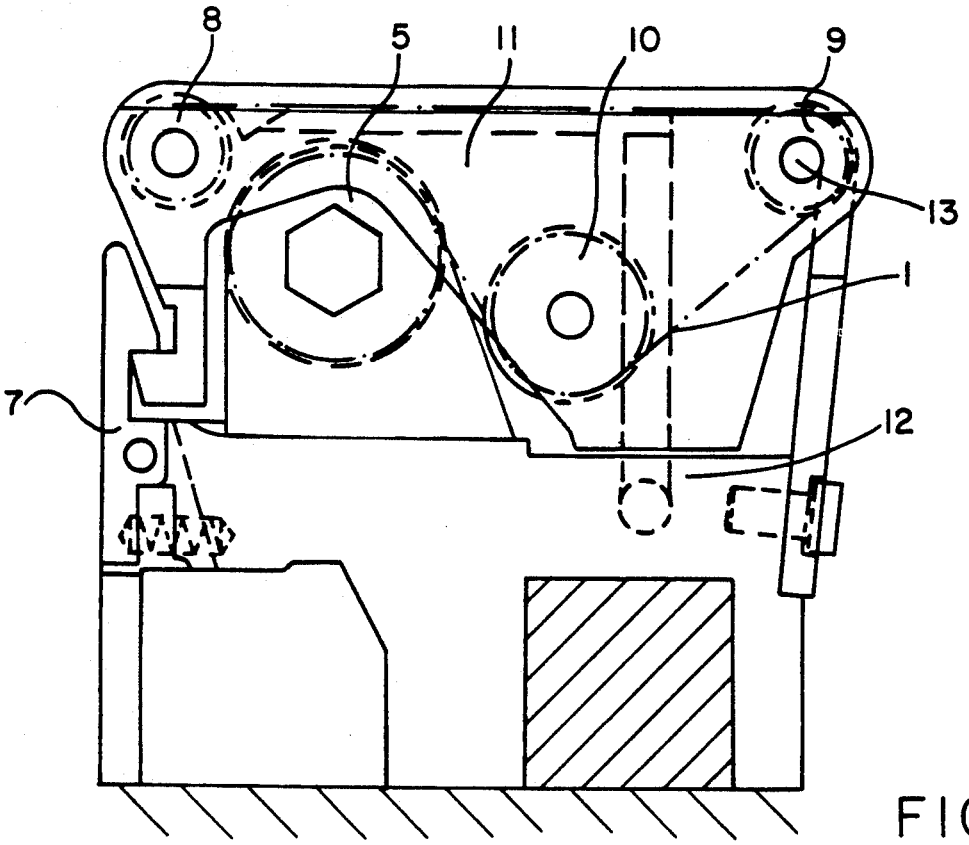
FIG. 1 is a somewhat schematic side elevation of the sheet conveyor table of the present invention.

Turning now to the drawings, FIG. 1 shows a side elevational view of the sheet conveyor table of the present invention. The conveyor table includes a top or upper portion 11 and a bottom or lower portion 12. The lower portion 12 is stationarily mounted adjacent the delivery unit of a printing machine. The top portion 11 is connected to the bottom portion via a swivel joint 13 and a releasable catch 7. In this way, the top portion 11 may be quickly interchanged with a second top portion having a different width, thereby adapting the conveyor table of the present invention to support sheets of various sizes.

An endless conveyor belt 1 is disposed for movement about the top portion 11 of the conveyor table. More specifically, the top portion 11 includes first and second guide rollers 8 and 9 coupled with a tensioning roller 10 that, together, define the path of movement of the conveyor belt 1. The motive force for propelling the conveyor belt 1 is provided by a drive wheel 5 which is rotatably mounted on the lower portion 12 of the table, so as to engage the outer surface of the conveyor belt 1. In this way, rotation of the drive wheel 5 imparts a circulatory motion to the endless conveyor belt 1.

As previously mentioned, the upper portion 11 is readily interchangeable, via the catch 7 and swivel joint 13. A further aspect of this coupling combination is directed to the tension adjustment of the conveyor belt 1. An adjustable slide 14 is provided on the upper portion 11 for engagement by catch 7, so as to vary the closure of the upper portion 11. As shown in FIG. 1, the catch 7 is preferably pivotally mounted on the lower portion 12 and is biased toward engagement with the adjustable slide 14 by means such as a spring 15. It will be appreciated from the opposing path of the conveyor belt 1 about the drive wheel 5 and the tensioning roller 10, that varying this closure by adjusting the slide 14 also selectively adjusts the tension in the conveyor belt 1.

Figure 2:
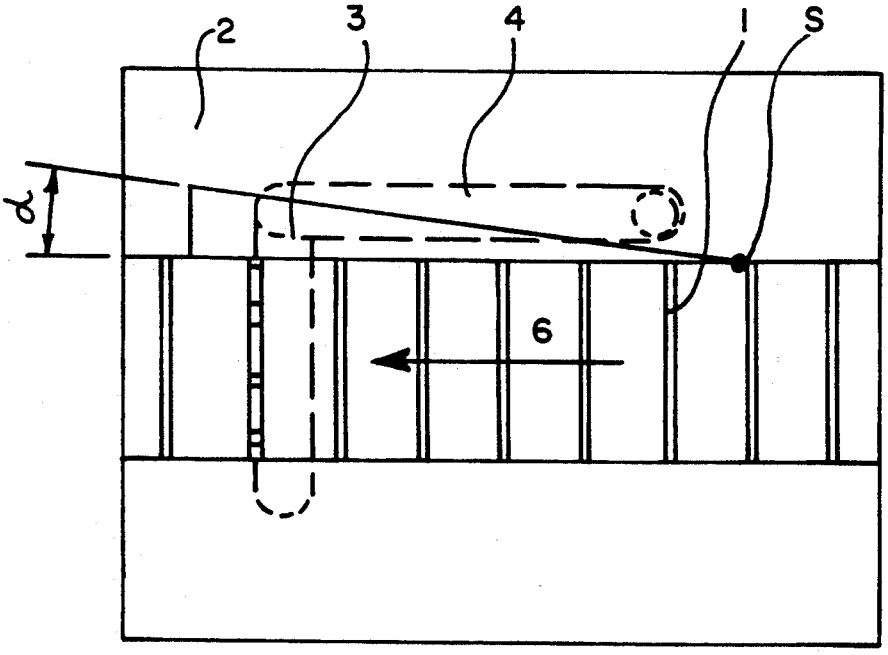
FIG. 2 is a top plan view thereof.

Turning now to FIG. 2, a top plan view of the sheet conveyor table is shown. Sheet material is transferred to the conveyor table via a gripping means, such as are typically employed in the delivery side of a printing press. The sheet material is then transported by the conveyor belt 1 traveling in direction 6 (indicated by the arrow) to a final, stacked position. A guide plate 2 on the surface of the upper portion 11 is disposed substantially parallel and closely adjacent to the conveyor belt 1 and helps position the sheets during travel along the table.

A suction aperture 3 formed in the guide plate 2 is in fluid communication with a suction chamber 4, which is further connected to a vacuum source VS, shown schematically in the lower portion 12 of the conveyor table, that generates a suction force. In keeping with the present invention, the vacuum source VS can include a fan or blower of any type suitable for generating a substantial air flow; the air flow being drawn inwardly through the suction aperture 3, through the suction chamber 4, and finally out through the blower. It will be appreciated that the restricted opening provided by the suction aperture 3 enhances resulting the vacuum, thereby providing an increased suction hold-down force upon the sheet materials.

Pursuant to a further and important aspect of the present invention, the suction aperture 3 is generally wedge-shaped, having an apex at a point S and with one side substantially parallel to the path of the conveyor belt 1 and the other side diverging outwardly from the conveyor belt 1 with respect to the direction of travel 6. This divergence defines an angle $\alpha$ (alpha) that ranges from one to ten degrees, depending upon the type of sheet material being transferred. In a particular preferred embodiment, the angle $\alpha$ (alpha) is eight degrees, thereby providing the optimum performance for the braking and positioning aspects of the present invention.

To more particularly illustrate the operation of the present invention, sheet materials are transferred to the conveyor table by a printing press gripper means (not shown) at a relatively high rate of speed. The conveyor belt 1, however, is typically traveling at a much slower rate, so that the sheets may be uniformly stacked for packaging or other disposition. As the light-weight sheet material, such as paper or cardboard, traveling over the conveyor belt 1 is exposed to the suction aperture 3, the vacuum force applied therefrom pulls the sheets down into a snug engagement with the conveyor belt 1. This suction pull-down force slows or brakes the sheets to the rate of travel of the belt 1.

The divergent angle $\alpha$, or wedge shape, of the suction aperture 3 advantageously allows for a gradual and progressive braking of the sheet material over the span of the conveyor table. A further advantage of the divergent shape is the increased suction hold-down provided at the wide end of the wedge-shaped aperture 3, since it is important to maintain proper control and positioning of the sheets as they are transported off the table to their final, stacked position. The wide end of the suction aperture 3, therefore, serves to provide an increased suction pull-down force on the tail end of the sheets during stacking, thereby resulting in a more uniform stack.

I claim:

1. A sheet conveyor table including suction apparatus for delivering sheets from a printing press to a stacking unit comprising in combination:

a conveyor table supporting an endless conveyor belt for transporting sheets;

said conveyor table including a vacuum source and having a lower portion disposed adjacent the delivery end of the printing press and supporting a rotatably mounted drive wheel, said drive wheel engaging the outer periphery of said conveyor belt;

said conveyor table having an upper portion coupled to the lower portion and having a first guide roller facing said sheet stacking unit, a second guide roller remote from said sheet stacking unit, and a tension roller, said conveyor belt being trained about said rollers, said upper portion also having a suction chamber in fluid communication with said vacuum source;

a guide plate on the surface of said upper portion disposed substantially parallel and closely adjacent to said conveyor belt, said guide plate having a suction aperture in fluid communication with said suction chamber, and said suction aperature being generally wedge-shaped with one side substantially parallel to the path of said conveyor belt and another side angularly disposed to the path of said conveyor belt at a diverging angle, alpha, of between about 1 degree and 10 degrees with respect to the conveying direction of the conveyor belt, the apex S of said angle, alpha, being disposed adjacent the end of said guide plate remote from said stacking unit;

whereby air flow through said suction aperture, said suction chamber, and said vacuum source creates a suction force for braking and positioning said sheets on said conveyor belt during transport, said suction force varying in proportion with the angle, alpha, of said suction aperture.

2. The apparatus of claim 1, wherein said diverging angle, alpha, is about 8 degrees.

3. The apparatus of claim 1, wherein said upper portion is selectively removable and is coupled to said lower portion by way of a spring-biased releasable catch at one end and a swivel joint at the other end thereof.

4. The apparatus of claim 3, wherein said releasable catch is engageable with an adjustable slide so as to vary the tension of said conveyor belt.

5. The apparatus of claim 4, wherein said diverging angle, alpha, is about 8 degrees.

* * * * *